US005730631A

United States Patent [19]

Tsang

[11] Patent Number: 5,730,631

[45] Date of Patent: Mar. 24, 1998

[54] STRUCTURE OF PLUG PINS

[76] Inventor: Lan-Jen Tsang, No. 1, Lane 199, Sec. 1, Ming-Chuan Rd., Tainan, Taiwan

[21] Appl. No.: 723,773

[22] Filed: Sep. 30, 1996

[51] Int. Cl.[6] ..... H01R 4/10

[52] U.S. Cl. ..... 439/881

[58] Field of Search ..... 439/736, 881, 439/884, 885, 601, 692, 697

[56] References Cited

U.S. PATENT DOCUMENTS

| | | | |
|---|---|---|---|
| 3,609,630 | 9/1971 | Francis | 439/736 |
| 3,614,715 | 10/1971 | Marx | 439/736 |
| 3,668,779 | 6/1972 | Turner | 439/736 |
| 5,207,603 | 5/1993 | Peloza | 439/884 |
| 5,556,308 | 9/1996 | Brown et al. | 439/884 |

*Primary Examiner*—Gary F. Paumen
*Assistant Examiner*—Katrina Davis
*Attorney, Agent, or Firm*—Morton J. Rosenberg; David I. Klein; Jun Y. Lee

[57] ABSTRACT

The present invention provides a structure of a plug pin which comprises a rectangular strip sheet having three terminal lugs at one end, and an open slot with two terminal lugs at respective sides of the open slot formed on the other end opposite the three terminal lugs. The strip sheet is folded about a center position in order to overlap two sides of the strip which are pressed tightly together. Two side terminal lugs of the three terminal lugs are bent horizontally in one direction and the central terminal lug is bent in an opposite direction to extend through the open slot to form three staggered terminal lugs for securing an electric cord thereat.

2 Claims, 7 Drawing Sheets

STRUCTURE OF PLUG PINS

BACKGROUND OF THE INVENTION

1. Field of the Invention

The present invention relates to the structure of plug pins, and more particularly to a design which minimizes waste material, reduces the production cost, and produces a more solid structure.

2. Prior of Art

It is understood that the material of plug pins have taken a great deal of proportion in the production cost of the plug, therefore, the less material wasted in the production line, the lower the production cost it will be. In accordance with the conventional pins, the shape of the unfolded strip is in a longitudinal flat plate which wastes a lot of material when forming the extending portions at respective ends, as shown in FIG. 5. When punching a row unfolded strips A of the plug pins on a blank sheet material from side by side, the area enclosed between two adjacent unfolded strips A is the portion B of the material to be wasted, in general, the waste material B has a large proportion and increasing a great of production cost.

In accordance with the conventional plug pin C, as shown in FIG. 6, which consists of three portions, a main body of the pin C1, a clip C2 and supporting strips C3, wherein the clip C2 is to clip an electric cord directly, and the supporting strips C3 are to keep the pin C1 in an upright position on the plug laterally in a secure manner. These three portions form the I-shaped pin so that both ends and the extending portions are employed as a clip clipping the cord and two lateral supporting strips C3 providing supporters for the pin. Hence, the function takes the leading role in the final, that is why the production cost of the conventional plug pin can hardly be dropped. On the other hand, due to the limited area in the plug, the conventional plug pins are designed in a flat wide type plug D for embedding so big and many supporting strips in the inside of the plug that they can not be used in a narrow rectangular type plug. Therefore said conventional plug pins have no good versatility.

OBJECTS AND SUMMARY OF THE INVENTION

In accordance with above-mentioned shortcoming the conventional plug pins, it is a main object of the present invention to provide a pin structure of plug that applies a rectangular unfolded strip instead of said I-shaped unfolded strip to meet the goal of saving material without losing all functions of the conventional plug pin. The present invention provides a rectangular unfolded strip to minimize the space between two adjacent strips which includes three wide terminal lugs at one end adjacently and an open slot at the opposite end, and two terminal lugs at both sides so that when folding the strip, the two side terminal lugs at the end with three terminal lugs are bent outwardly and horizontally for locating and supporting the plug pin, and the center terminal lug is bend towards the open slot of the other end with the two terminal lugs next to the open slot to form a staggering clip to fix the cord.

DETAILED DESCRIPTION OF PREFERRED EMBODIMENTS

Figure 1:
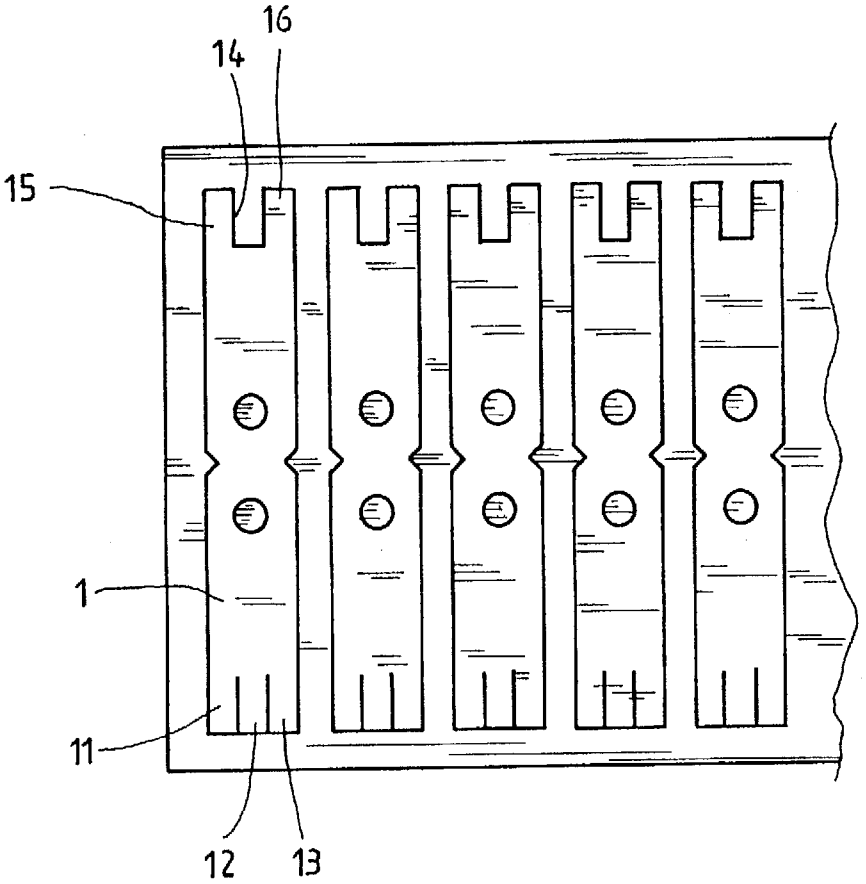
FIG. 1 is a top view Showing a punching sheet with a number of plug pins of the present invention.
Figure 2:
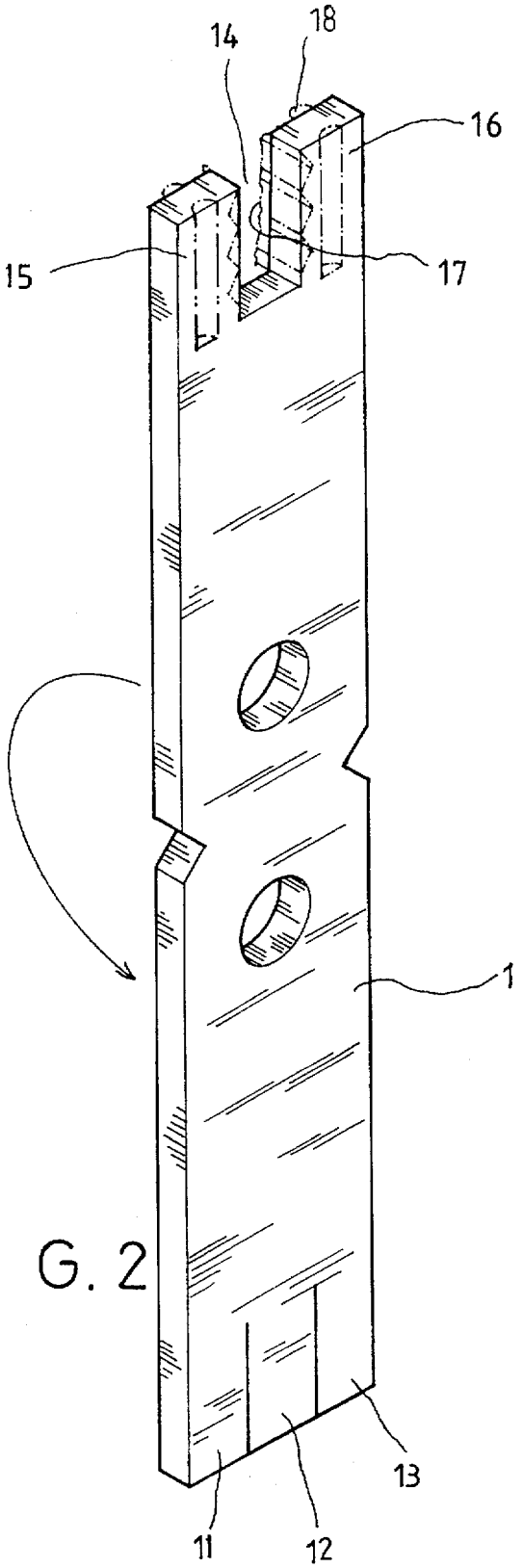
FIG. 2 is a perspective view showing an unfolded strip of the present invention.

Referring to FIG. 1, the present invention, as to an ordinary rectangular unfolded strip 1, is produced by punching out from a blank sheet material in rows side by side, in this way the space between each adjacent unfolded strip 1 can be minimized. Comparing with the above-mentioned conventional plug pins, the wasted material can also be minimized. The unfolded strip 1 of the present invention, as shown in FIG. 2, has three terminal lugs 11, 12 and 13 arranged adjacently at one end, and an open slot 14 with two terminal lugs 15 and 16 on respective sides at the other end.

Figure 3:
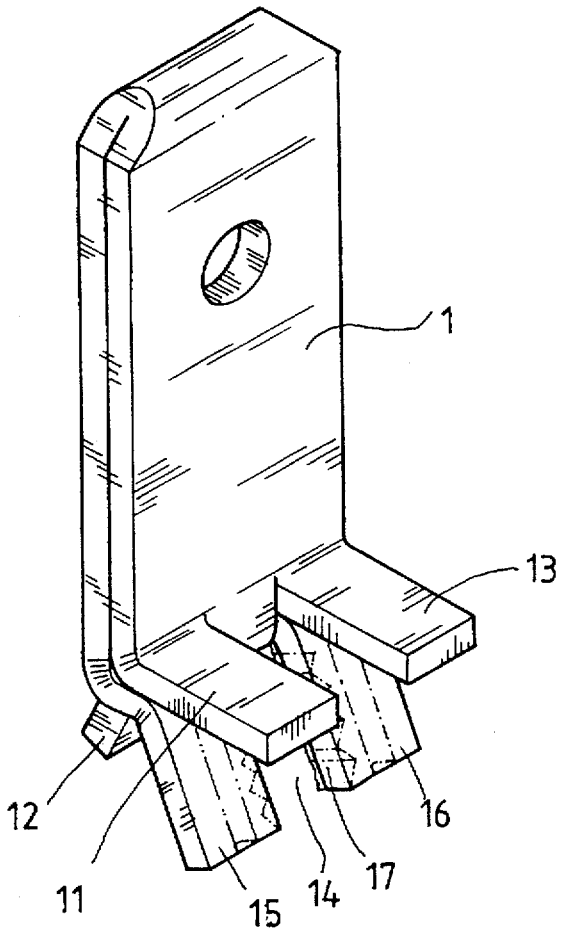
FIG. 3 is a perspective view of the present invention being folded.
Figure 4:
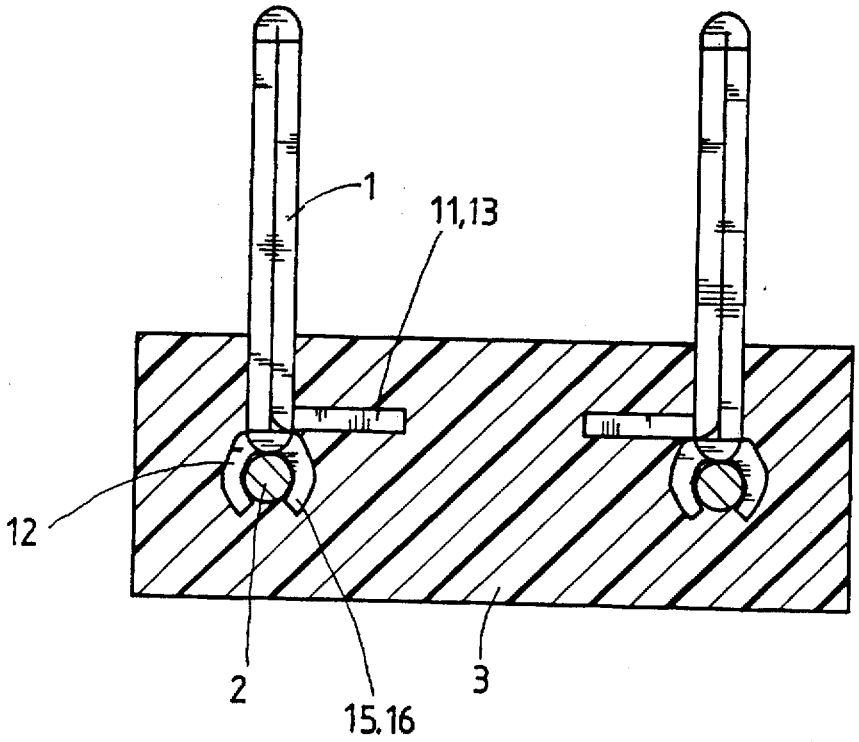
FIG. 4 is a cross-section view showing an operation of the present invention.
Figure 5:
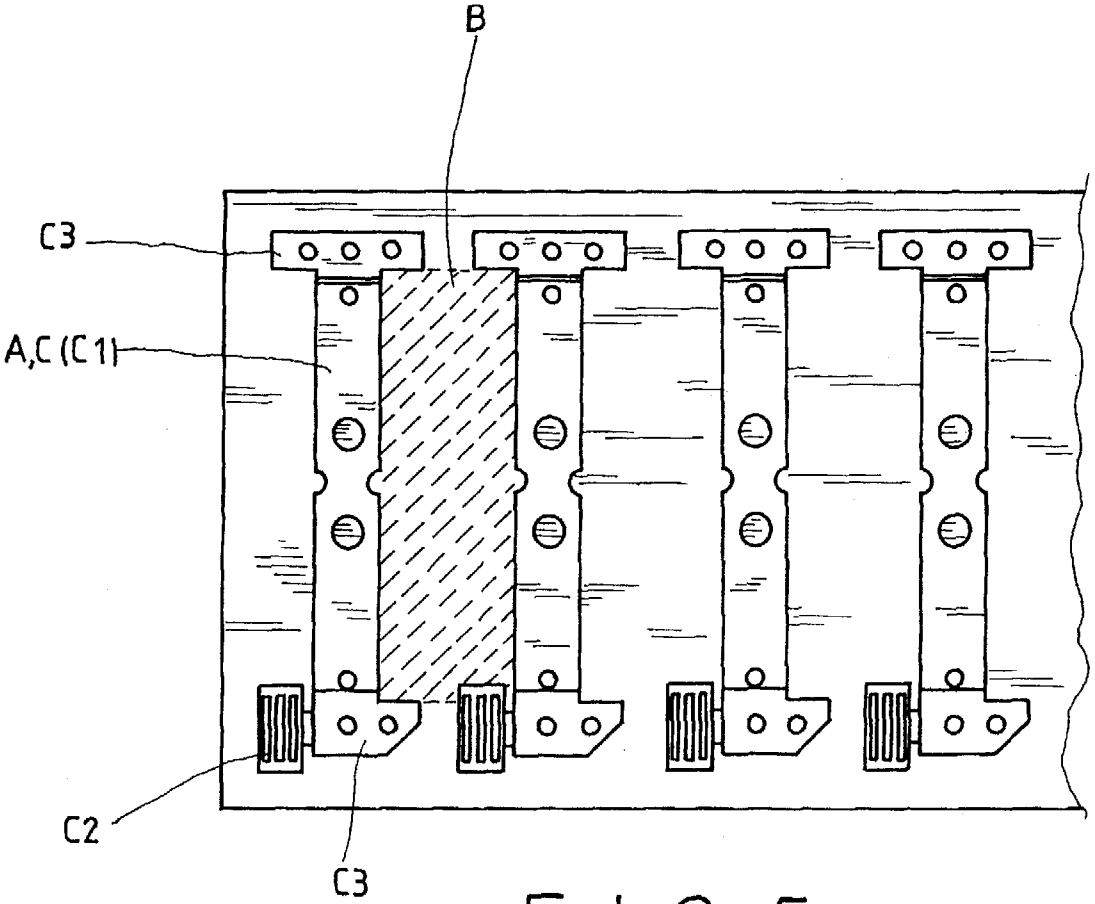
FIG. 5 (PRIOR ART)
FIG. 5 is a top view showing the punching sheet of a conventional plug pin.
Figure 6:
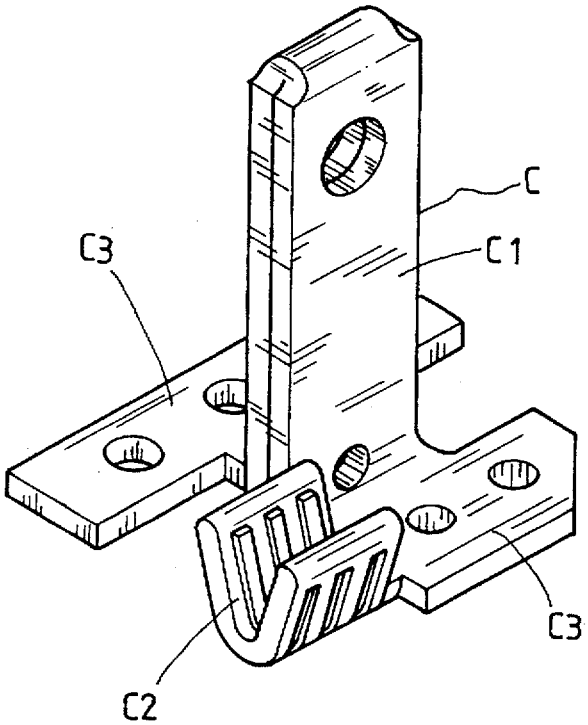
F I G. 6 (PRIOR ART)
FIG. 6 is a perspective view of the conventional plug pins shown in FIG. 5.
Figure 7:
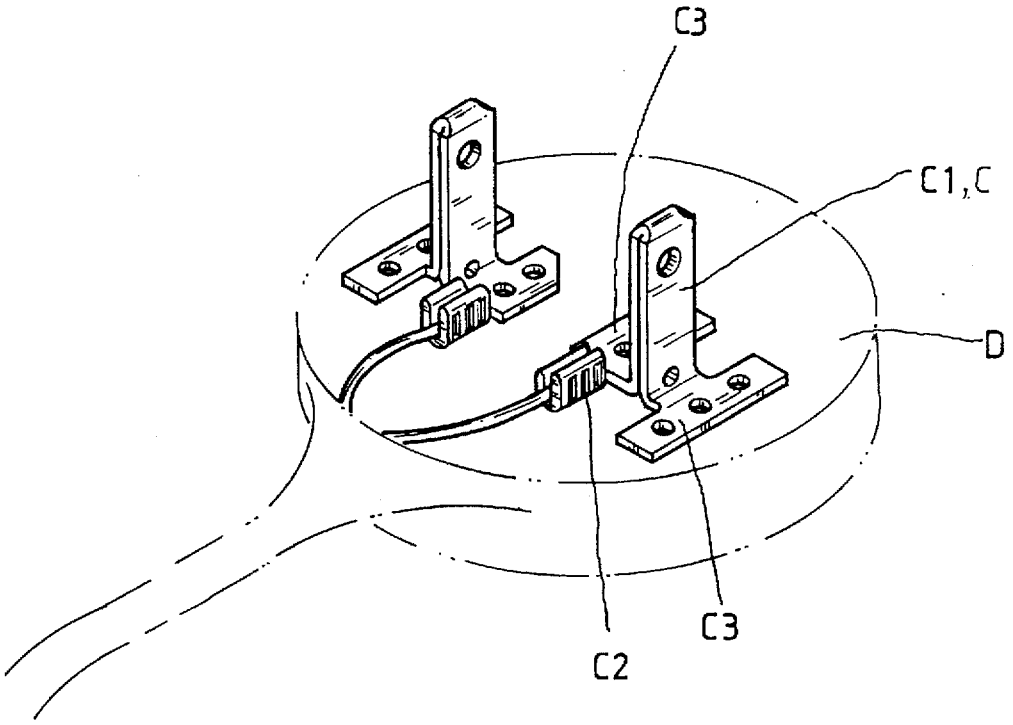
F I G. 7 (PRIOR ART)
FIG. 7 is a solid view of a conventional plug.

Referring to FIG. 3, in processing, folding the unfolded strip 1 at center portion, bending the two terminal lugs 11 and 13 towards one side and the terminal lug 12 towards the opposite side passing through the open slot 14 between the two terminal lugs 15 and 16 so that the three terminal lugs 12, 15 and 16 are curved towards opposite side respectively and staggeringly to form a cross socket groove for receiving and securing an electric cord 2. Coordinating to the plug 3, the pins holding the cords 2 on are molded in. The terminal lugs 11 & 13 bending outwardly function as two supporting lugs to keep the pin standing upright. Controlling the length of the terminal lugs 11 & 13, the pins are not only appropriate to the ordinary flat wide thin plug but also appropriate to the narrow rectangular plug, so it has a wide versatility. Additionally, the two terminal lugs 15 and 16 are formed integrally with meshing teeth 17 at respective inner sides opposing to each other, as showing in FIG. 3, to catch the cord 2 for preventing the cord 2 from sliding loosen. And the staggering terminal lugs 12, 15 and 16 are formed integrally with a convex 18 along the longitudinal inner surfaces opposing each other respectively for securing the cord thereat.

In addition, the unfolded strip 1 can be doubled back to form a hollow column as a column plug pin.

I claim:

1. A plug pin comprising:

a rectangular strip sheet having at an end thereof a pair of outer terminal lugs and an inner terminal lug therebetween, said strip sheet having at an opposing end thereof two spaced apart terminal lugs and an open slot therebetween, said rectangular strip sheet being folded about a center line thereof into two opposing segments, said opposing segments being pressed tightly together and extending in a longitudinal direction, said pair of outer terminal lugs being bent to extend transversely in a first direction and said inner terminal lug being bent to extend through said open slot in a second direction, said second direction opposing said first direction to form a staggered relationship between said pair of outer terminal lugs and said inner terminal lug.

2. The plug pin as recited in claim 1, wherein each of said spaced apart terminal lugs has an inner edge facing said open slot, said inner edge has meshing teeth formed therein.

* * * * *